United States Patent [19]

Townsend

[11] 4,035,091

[45] July 12, 1977

[54] TRAINING DEVICE FOR STUDENTS OF STENOGRAPHY

[76] Inventor: Barbara B. Townsend, 1175 Wheaton St., Memphis, Tenn. 38117

[21] Appl. No.: 683,314

[22] Filed: May 5, 1976

[51] Int. Cl.[2] ..... B43K 25/00; B43K 29/00

[52] U.S. Cl. ..... 401/52; 401/115; 401/195

[58] Field of Search ..... 401/52, 195, 115, 209; 35/26; 273/72 R, 29 A; 15/443

[56] References Cited

U.S. PATENT DOCUMENTS

| | | | |
|---|---|---|---|
| 2,964,812 | 12/1960 | Cook | 401/52 |
| 3,501,244 | 3/1970 | Kulka | 401/195 |
| 3,521,883 | 7/1970 | Hamilton | 273/72 R |
| 3,716,239 | 2/1973 | Goodreau | 273/29 A |

FOREIGN PATENT DOCUMENTS

| | | | |
|---|---|---|---|
| 663,362 | 5/1963 | Canada | 401/115 |
| 769,740 | 3/1957 | United Kingdom | 401/115 |

*Primary Examiner*—Stephen C. Pellegrino
*Attorney, Agent, or Firm*—John R. Walker, III

[57] ABSTRACT

A training device for assisting a student in his endeavor to develop an optimum writing speed, particularly in the art of stenography. The device includes a writing instrument, e.g., a ball-point pen or the like, for manually scribing the characters prescribed in the art. The device is characterized by a cumbersome weight being attached to the writing instrument for exercising and overdeveloping or strengthening the student's muscles that are normally utilized while making the prescribed characters. The student subsequently substitutes the training device with a conventional light weight writing instrument which he is now capable of using with extraordinary dexterity.

13 Claims, 9 Drawing Figures

TRAINING DEVICE FOR STUDENTS OF STENOGRAPHY

BACKGROUND OF THE INVENTION

1. Field of the Invention

This invention relates to the field of writing instruments and is particularly directed toward stenographic writing instruments.

2 Description of the Prior Art

Developing the writing skills deemed essential in the art of stenography has plagued stenography students, no doubt, since the conception of the art. A trend, in the state of the art, which is intended to aid the stenography student has been to ever decrease the weight of the writing instrument. However, this reduction in weight concept has not made any contribution toward reducing the amount of training time involved for properly developing a stenographer. As a matter of fact, these lighter weight pens may have just the opposite effect, i.e., requiring more training time for developing the writing speed. In other words, applicant contents that the sooner the muscles used in making the prescribed characters are properly strengthened, the sooner the student will achieve the optimum writing speed. It seems logical that, if the student uses a lighter weight writing instrument, the amount of training time for strengthening the muscles will be extended rather than shortened. Accordingly, applicant's concept is launched from this premise.

It should also be mentioned that fewer and fewer students are now entering stenography classes. The reasons for this trend are many. However, one of the foremost reasons is that the training period is considered to be very long.

SUMMARY OF THE INVENTION

The present invention is directed towards overcoming certain problems relative to learning the art of stenography. The concept of the present invention is to provide a training device that will shorten the stenography training period. The device is intended to be used by the stenography student in the classroom and at his home as he practices and trains in the art of stenography. The device includes a writing instrument, e.g., a ball-point pen or the like, for manually scribing the characters prescribed in the art. The device is characterized by a cumbersome weight being attached to the writing instrument for exercising and overdeveloping or strengthening the student's muscles that are normally utilized while making the prescribed characters. The ultimate result is the student quickly achieves extraordinary dexterity, i.e, when he subsequently substitutes the training device with a conventional light weight writing instrument for he is now capable of writing the prescribed characters with the speed deemed essential in the art of stenography.

Applicant has conducted experiments which show that students using the training device of the present invention attain an optimum writing speed in a considerably shorter training period than heretofore. Therefore, the training device of the present invention is considered to be critical to the secretarial field. This is believed true since the students may now develop the essential writing speed in a more reasonable or shorter training period which should stimulate greater interest and participation in stenography classes. Additionally, the stenography student could attain a higher skill by using the training device of the present invention if enrolled for the same number of class hours as heretofore.

The concept of the present invention correlates with the well known concept of training athletes, particularly the concept of placing weights on the feet of a sprinter during training sessions and removing the weights during competition. In other words, the results for the sprinter are the same as the results for the stenography student since the object is to strengthen the muscles that are normally used for the task to be performed. Accordingly, removing the handicap or the cumbersome weight of applicant's device enables the stenography student to now accomplish the prescribed task with ease and extraordinary dexterity.

DESCRIPTION OF THE PREFERRED EMBODIMENT

The training device 11 of the present invention is intended to be used in assisting a student in his endeavor to develop certain skills pertaining to the art of stenography, e.g., the ability to expeditiously write the indicia pertaining to the art. The training device 11 includes a writing instrument 13, preferably a ball-point pen or the like, for manually scribing the prescribed characters peculiar to the art. Also included is cumbersome weight means 15 attached to the writing instrument 13, in a manner to be described, for exercising and overdeveloping or strengthening the student's muscles that are normally utilized while making the prescribed characters with the ultimate result being explicitly improved dexterity by the student when he subsequently substitutes the training device 11 with a conventional writing instrument.

Figure 1:
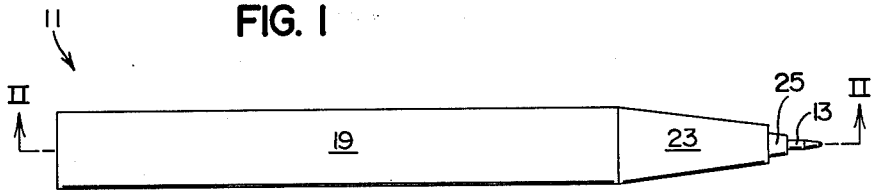
FIG. 1 is a side elevational view of the training device of the present invention, with FIG. 2 being a sectional view taken as on the line II-II thereof.
Figure 2:
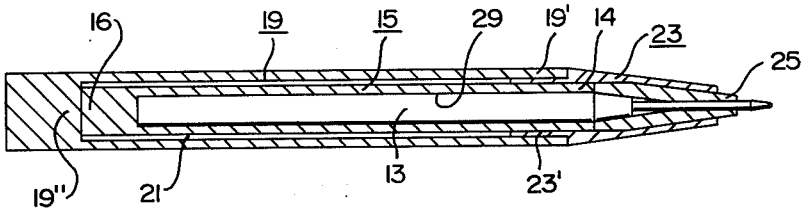

From FIG. 2 of the drawing it may clearly be seen that the device 11 includes an exterior barrel member 19 and the writing instrument 13 as shown therein consists of a typical "refill" ball-point pen member with the exterior barrel member 19 enveloping the writing instrument or ball-point pen member 13. Also, it may clearly be seen that the inner diameter of the exterior barrel member 19 exceeds the outer diameter of the ball-point pen member 13 and thus a cavity, as at 21, is established therebetween. In this embodiment, the cumbersome weight means 15 preferably is constructed so as to have a size and shape to substantially conform to the cavity 21 with the exterior barrel member 19 also enveloping the weight means 15 as the weight means 15 circumferentially engages the ball-point pen member 13.

From FIG. 2 of the drawing it may also be seen that the training device 11 includes adaptor means, as at 23, 25 for removably joining the ball-point pen member 13; the exterior barrel member 19; and the cumbersome weight means 15 one with the other. It will be understood that the tapered adaptor means 25 is inserted within the tapered adapter means 23 as clearly shown in FIG. 2 of the drawing. Additionally, the adaptor means 23 includes an exterior threaded portion as at 23′ for threaded engagement with an internally threaded portion, as at 19′ of the barrel member 19. Further, the weight means 15 includes a portion 14, which bears against the adaptor means 25. Also, the weight means 15 includes a portion 16 which bears against a portion 19″ of the barrel member 19. Thus, the ball-point pen member 13 is held stationary within the barrel member 19.

Figure 3:
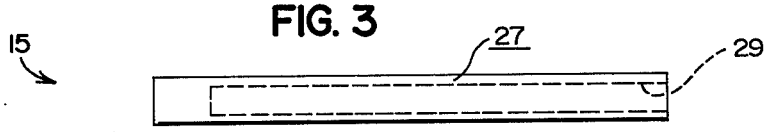
FIG. 3 is a side elevational view of the cumbersome weight means as shown internally disposed within the device of FIG. 2.

From FIGS. 2 and 3 of the drawing it may clearly be seen that the weight means 15 includes a socket like body portion 27 which is provided with an elongated bore 29. The ball-point pen refill 13 is received within the bore 29 with the weight means 15 or the socket like body portion 27 being circumferentially disposed about at least a portion of the writing instrument 13 or the ball-point pen refill.

Figure 4:
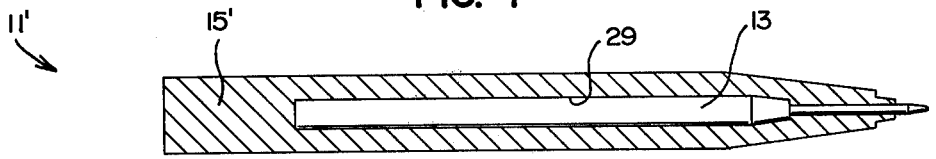
FIG. 4 is a sectional view of an alternate embodiment of the training device of the present invention and depicts the weight means being integrally formed with a writing instrument.

Particular attention is now directed toward FIG. 4 of the drawing where it may be seen that an alternate embodiment of the training device or throw away (disposable) embodiment is herein disclosed and is character referenced herein by the numeral 11′. The training device 11′ is characterized by having the ball-point pen refill 13 integrally joined with an alternate embodiment of the cumbersome weight means which is character referenced by the numeral 15′. In other words, the weight means 15′ is provided with the elongated bore or socket 29 and the ball-point pen refill member 13 is inserted in the socket 29 and is fixedly received therein, in any well known manner, with the weight means 15′ establishing the permanent exterior of the training device 11′.

Figure 5:
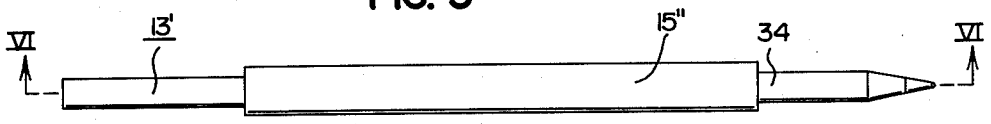
FIG. 5 is a side elevational view of still another embodiment of the present invention depicting the weight means attached to a conventional ball-point pen, with FIG. 6 being a sectional view taken as on the line VI—VI thereof.
Figure 6:
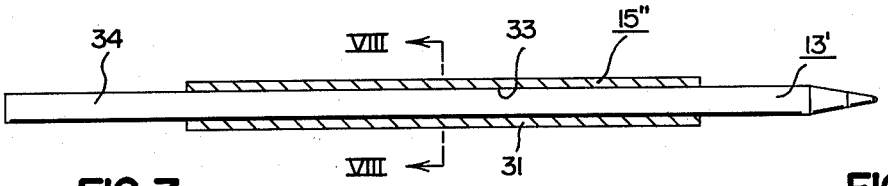
Figure 7:
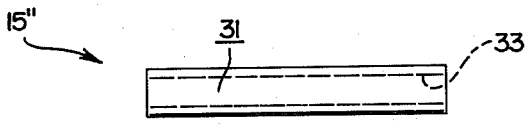
FIG. 7 is a side elevational view of the weight means removed from the ball-point pen depicted in FIGS. 5 and 6.
Figure 8:
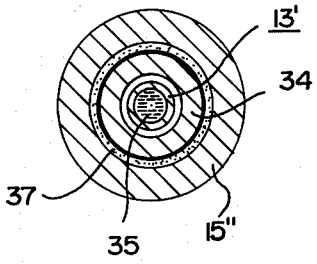
FIG. 8 is a sectional view taken as on the line VIII—VIII of FIG. 6.

Particular attention is now directed towards FIGS. 5 through 9 of the drawings wherein it may be seen that a third embodiment of the weight means is herein disclosed and is character referenced by the numberal 15″. The weight means 15″ includes a tubular body 31, i.e., having an elongated aperture 33 extending therethrough, with a somewhat modified version of the writing instrument or ball-point pen which is characterized by the numeral 13′ extending longitudinally through the aperture 33. The weight means 15″ is circumferentially disposed about at least a portion of the writing instrument 13′. It should be understood that the writing instrument 13′ as depicted in FIGS. 5 and 6 preferably is of the non-refillable throwaway or disposable type, i.e., being of the well known type which includes an exterior barrel member characterized herein by the numeral 34. FIG. 8 of the drawing clearly shows the ball point pen 13′ containing a reservoir of ink 35 and the pen 13′ being enveloped within the exterior barrel member 34. From FIGS. 6 through 8 of the drawings it may clearly be seen that the tubular body 31 is shorter than the ball-point pen or writing instrument 13′. Additionally, the weight means 15″ includes means, e.g., adhesive means 37 or the like, for fixedly attaching the weight means 15″ or the tubular body 31 to the exterior barrel 34. In this regard, the weight means 15 as shown in FIG. 3 of the drawing may optionally be permanently affixed to the ball-point pen member 31 in any well known manner, e.g., in like manner as just disclosed for the weight means 15″, which would means the weight means 15 (FIG. 3) would be discarded when the ball-point pen member 13 to be replaced.

Figure 9:
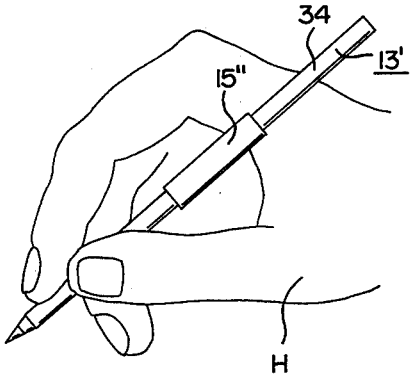
FIG. 9 depicts the training device as shown in FIG. 5 in a preferred arrangement with respect to the hand of a student.

It should be understood that the adhesive means 37 may be substituted with gripping means, e.g., the tubular body 31 might have an inner lining of sponge rubber or the like in lieu of the adhesive means 37, for yieldably gripping the exterior barrel member 34 selectively at various locations along the length thereof for selectively removably fixing the weight means 15″ at any one of numerous locations along the length of the writing instrument 13′. FIG. 9 of the drawing clearly depicts the preferred location or arrangement of the weight means 15″ with respect to the student's hand, the hand being characterized by the capital letter H.

It should be understood that the concept of the present invention is to provide both embodiments of the training devices 11 and/or 11′ in a group or set, e.g., each set preferably includes at least three training devices. Each of the training devices within the set would have a cumbersome weight means of peculiar value or of a different magnitude. This particular concept is illustrated in FIGS. 5 through 9 wherein FIG. 5 shows a rather large weight 15″, FIG. 9 shows a rather small weight 15″, and FIG. 7 shows an intermediate size weight 15″. It should be mentioned that the optimum size for the intermediate size weight as shown in FIG. 7 is a nominal two inches in length. The magnitude of the weights 15, 15′ and/or 15″ may be adjusted in any manner well known to those skilled in the art, e.g., adjusting the size as shown in FIGS. 5 through 9 or selecting materials of different density or mass for the construction thereof. For example, the weight contained within the barrel of a ball-point pen is preferably 1.25 to 1.75 grams, which doubles or triples the weight of the pen. Also, the weight preferably would be of as heavy a material as possible, such as lead.

Although the invention has been described and illustrated with respect to preferred embodiments thereof, it is to be understood that it is not to be so limited since changes and modifications may be made therein are within the full intended scope of the invention.

I claim:

1. A training device for assisting a student in his endeavor to develop certain skills pertaining to the art of stenography, said training device comprising a writing instrument for manually scribing certain prescribed characters, and cumbersome weight means attached to said writing instrument for exercising and overdeveloping the student's muscles that are normally utilized while making the prescribed characters with the ultimate result being explicitly improved dexterity by the student when he subsequently substitutes said training device with a conventional writing instrument, said training device including an exterior barrel member, said barrel member substantially enveloping said writing instrument in a manner so that a cavity is established between the interior of said barrel member and the exterior of said writing instrument, said cumbersome weight means having a size and shape to substantially completely conform to said cavity with said barrel member also enveloping said weight means as said weight means is attached to said writing instrument.

2. The training device as set forth in claim 1 in which said writing instrument includes adaptor means for removably adapting said writing instrument, said exterior barrel member, and said cumbersome weight means one with the other.

3. In combination with a writing instrument which may be grasped by a student in his endeavor to develop writing skills as he makes prescribed characters with said writing instrument, of cumbersome weight means attached to said writing instrument for exercising and overdeveloping the student's muscles that are normally utilized while making the prescribed characters with the ultimate result being explicitly improved dexterity by the student when he subsequently reverts to conventional writing instruments, and of an exterior barrel member, said writing instrument including a ball-point pen member with said exterior barrel member enveloping said ball-point pen member, said exterior barrel member having an inner diameter which exceeds the outer diameter of said ball-point pen member thus a cavity is established therebetween, said cumbersome weight means having a size and shape to substantially completely conform to said cavity with said exterior barrel member also enveloping said weight means as said weight means circumferentially engages said ball-point pen member.

4. The combination as set forth in claim 3 in which is included adaptor means for removably joining said ball-point pen member, said exterior barrel member, and said cumbersome weight means one with the other.

5. The combination as set forth in claim 3 in which said writing instrument includes a ball-point pen member, said cumbersome weight means being provided with an elongated socket, and said ball-point pen member being fixedly received within said socket with said cumbersome weight means establishing the permanent exterior of said training device.

6. Weight means for attachment to a writing instrument intended to be grasped by a stenographic student while manually making certain prescribed characters, said weight means including a socketlike body provided with an elongated bore and said writing instrument being received therein with said weight means being circumferentially disposed about at least a portion of said writing instrument, said weight means including means for selectively gripping said writing instrument selectively at various locations along the length thereof for selectively removably fixing said weight means at any one of numerous locations along the length of said writing instrument.

7. Weight means for attachment to a writing instrument intended to be grasped by a stenographic student while manually making certain prescribed characters, said weight means including a tubular body with said writing instrument extending longitudinally therethrough and said weight means being circumferentially disposed about at least a portion of said writing instrument, said weight means including means for selectively gripping said writing instrument selectively at various locations along the length thereof for selectively removably fixing said weight means at any one of numerous locations along the length of said writing instrument.

8. The weight means as set forth in claim 4 in which said tubular body is shorter than said writing instrument.

9. A training device for assisting a student in his endeavor to develop certain skills pertaining to the art of stenography, said training device comprising a writing instrument for manually scribing certain prescribed characters, and cumbersome weight means attached to said writing instrument for exercising and overdeveloping the student's muscles that are normally utilized while making the prescribed characters with the ultimate result being explicitly improved dexterity by the student when he subsequently substitutes said training device with a conventional writing instrument, said cumbersome weight means being provided with an elongated socket, said writing instrument being fixedly, substantially nonmovably received within said socket with said cumbersome weight means establishing the permanent exterior of said training device.

10. The training device of claim 9 in which said writing instrument includes a ball-point pen member.

11. In combination with a writing instrument which may be grasped by a student in his endeavor to develop writing skills as he makes prescribed characters with said writing instrument, of cumbersome weight means attached to said writing instrument for exercising and overdeveloping the student's muscles that are normally utilized while making the prescribed characters with the ultimate result being explicitly improved dexterity by the student when he subsequently reverts to conventional writing instruments, said writing instrument and said cumbersome weight means being permanently, nonmovably joined one to the other.

12. In combination with a writing instrument which may be grasped by a student in his endeavor to develop writing skills as he makes prescribed characters with said writing instrument, of cumbersome weight means attached to said writing instrument for exercising and overdeveloping the student's muscles that are normally utilized while making the prescribed characters with the ultimate result being explicitly improved dexterity by the student when he subsequently reverts to conventional writing instruments, said cumbersome weight means being provided with an elongated socket, said writing instrument being fixedly, substantially nonmovably received within said socket with said cumbersome weight means establishing the permanent exterior of said combination.

13. The combination of claim 12 in which said writing instrument includes a ball-point pen member.

* * * * *